US006244382B1

(12) United States Patent
Labonte

(10) Patent No.: US 6,244,382 B1
(45) Date of Patent: Jun. 12, 2001

(54) ATTACHMENT FOR STABILIZING AN EXTENSION LADDER

(76) Inventor: Leopold Labonte, 1053 Derian Pl., Nokomis, FL (US) 34875

( * ) Notice: Subject to any disclaimer, the term of this patent is extended or adjusted under 35 U.S.C. 154(b) by 0 days.

(21) Appl. No.: 09/548,871

(22) Filed: Apr. 13, 2000

(51) Int. Cl.[7] ..... E06C 7/00
(52) U.S. Cl. ..... 182/107; 182/214
(58) Field of Search ..... 182/107, 214, 182/206

(56) References Cited

U.S. PATENT DOCUMENTS

| | | | | |
|---|---|---|---|---|
| 708,443 | * | 9/1902 | Sibley | 182/214 |
| 799,782 | * | 9/1905 | Ellinger | 182/214 |
| 1,522,292 | * | 1/1925 | Enssle | 182/214 |
| 3,100,026 | * | 8/1963 | Sunshine | 182/214 |
| 3,146,854 | * | 9/1964 | Terwilliger | 182/214 |
| 3,712,419 | | 1/1973 | O'Hara . | |
| 4,311,207 | | 1/1982 | Lurry . | |
| 4,363,378 | | 12/1982 | Williams et al. . | |
| 4,593,790 | * | 6/1986 | Brewer | 182/107 |
| 4,643,274 | * | 2/1987 | Tataseo | 182/214 |
| 5,242,031 | | 9/1993 | Ashley . | |
| 5,460,240 | | 10/1995 | Jones . | |
| 5,638,916 | | 6/1997 | Schneider . | |
| 5,664,643 | * | 9/1997 | Taylor | 182/107 |
| 6,029,774 | * | 2/2000 | Cothern | 182/107 |

FOREIGN PATENT DOCUMENTS

| | | | | |
|---|---|---|---|---|
| 141308 | * | 5/1903 | (DE) | 182/214 |

* cited by examiner

*Primary Examiner*—Alvin Chin-Shue
(74) *Attorney, Agent, or Firm*—Kenneth L Tolar

(57) ABSTRACT

A ladder attachment for supporting a ladder in a substantially upright position while suspending the top end of the ladder a predetermined distance from a vertical surface includes an elongated central portion attachable to each side rail of the ladder. A pair of diverging arms are pivotably attached to the central portion each of which can be selectively repositioned relative thereto with a removable locking pin. A collapsible cross member interconnects the arms. Each end of the cross member is selectively positionable along the length of the corresponding arm. An elongated translatable shaft interconnects the central portion and the cross member to adjust the spacing between the arms.

7 Claims, 2 Drawing Sheets

ATTACHMENT FOR STABILIZING AN EXTENSION LADDER

BACKGROUND OF THE INVENTION

The present invention relates to an attachment for stabilizing and supporting an extension ladder a predetermined distance from a vertical surface to provide additional working space therebetween.

DESCRIPTION OF THE PRIOR ART

Extension ladders are often used in performing various tasks such as painting the exterior of buildings, trimming trees, washing windows, etc. The top end of the ladder is typically placed against a vertical surface such as the building or tree thereby providing minimal work space therebetween. Accordingly, a worker who ascends the ladder is positioned immediately adjacent the work surface which is awkward and tedious. Furthermore, when the extension ladder is resting against the work surface, it can easily shift or slide resulting in serious injury to the worker. The present invention provides a device securable to an extension ladder that securely anchors the ladder to a support surface while suspending the ladder a predetermined distance therefrom.

Various ladder safety attachment devices exist in the prior art. For example, U.S. Pat. No. 5,638,916 issued to Schneider relates to an attachment designed to secure the top of a ladder to a tree or pole to prevent rocking or sliding. The device includes a platform with two sets of spikes. The first set of spikes is fixed and is designed to engage a tree or pole when the ladder and attachment are placed thereagainst holding the ladder in an initial position. An operator on the ladder can adjust the second set of spikes to engage various diameter trees or poles.

U.S. Pat. No. 5,460,240 issued to Jones discloses a ladder and platform assembly for securing a ladder to a utility pole. The ladder is attached at one end to a platform and includes a pair of generally parallel spaced legs and a plurality of steps interconnecting the legs. The platform includes a latch assembly for stabilizing the platform when the platform is placed against the pole.

U.S. Pat. No. 5,242,031 issued to Ashley relates to an accessory positionable on top of a ladder having a pair of brackets which may be secured about the upper ends of the ladder rails. A laterally extending beam is secured to the brackets for resting on the upper rung of the ladder. The brackets each include a leg to which spaced sides of a work tray are journalled so that the tray may be rotated from an inoperative position overlaying the front of the ladder to an operative position extending transversely from the front of the ladder to the rear of the ladder.

U.S. Pat. No. 4,363,378 issued to Williams et al relates to a ladder securing device comprising two connectors for attaching to the rungs of the ladder. One of the connectors includes a first rotatable element on which is mounted a second rotatable element.

U.S. Pat. No. 4,311,207 issued to Lurry relates to a ladder attachment including an adjustable frame assembly attachably connected to a section of a conventional extension ladder. The frame assembly cooperates with the side rails of the ladder to form a hook portion for extending over the ridge of a pitched roof thereby allowing the ladder to be supported in an inclined position on the roof U.S. Pat. No. 3,712,419 issued to O'Hara relates to a ladder attachment including a spring biased rod adapted to frictionally engage the bottom surface of building eaves whereby the ladder is held in a substantially vertical operative position relative to the building.

Although various devices for securing a ladder to buildings and the like exist, none include all of the features and advantages of the present invention. The present invention includes a pair of spaced outer arms attachable to the ladder side rails that extend outwardly from the ladder to abut a vertical surface thereby supporting the top end of the ladder a predetermined distance therefrom. Furthermore, the distance between the arms may be selectively varied so that the arms tightly encompass an elongated vertical structure such as a pole or tree.

SUMMARY OF THE INVENTION

The present invention relates to an attachment for stabilizing and supporting an extension ladder. The device comprises an elongated central portion having a pair of spaced side arms pivotably attached thereto. The central portion is securable to the ladder side rails with a pair of mounting brackets whereby the side arms extend outwardly relative to the ladder. Interconnecting the side arms is a cross member comprised of multiple independently pivoting sections that may be extended and collapsed. Extending from the cross member are a plurality of spikes for penetrating a tree or similar surface. A spring-biased translatable shaft is attached at one end to the cross member and at the other to the central portion for selectively varying the spacing between the arms. It is therefore an object of the present invention to provide a ladder attachment that suspends a ladder a predetermined distance from a vertical surface.

It is another object of the present invention to provide a ladder attachment that secures the top end of a ladder to a vertical structure.

It is yet another object of the present invention to provide a ladder attachment that can be adjusted to encompass varying diameter vertical structures. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
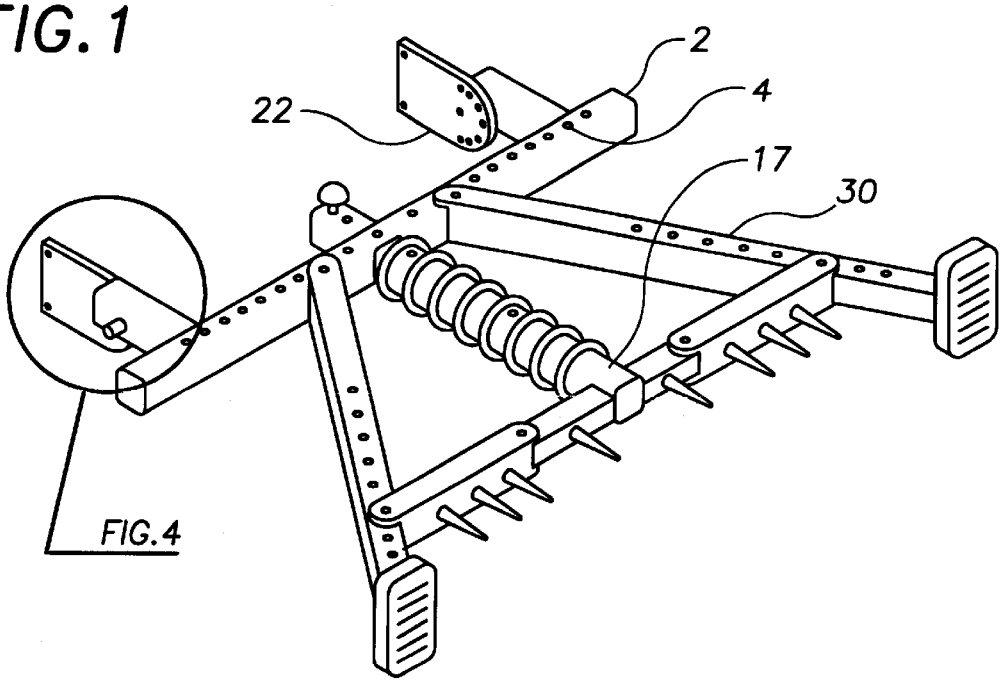
FIG. 1 is a perspective view of the device.
Figure 2:
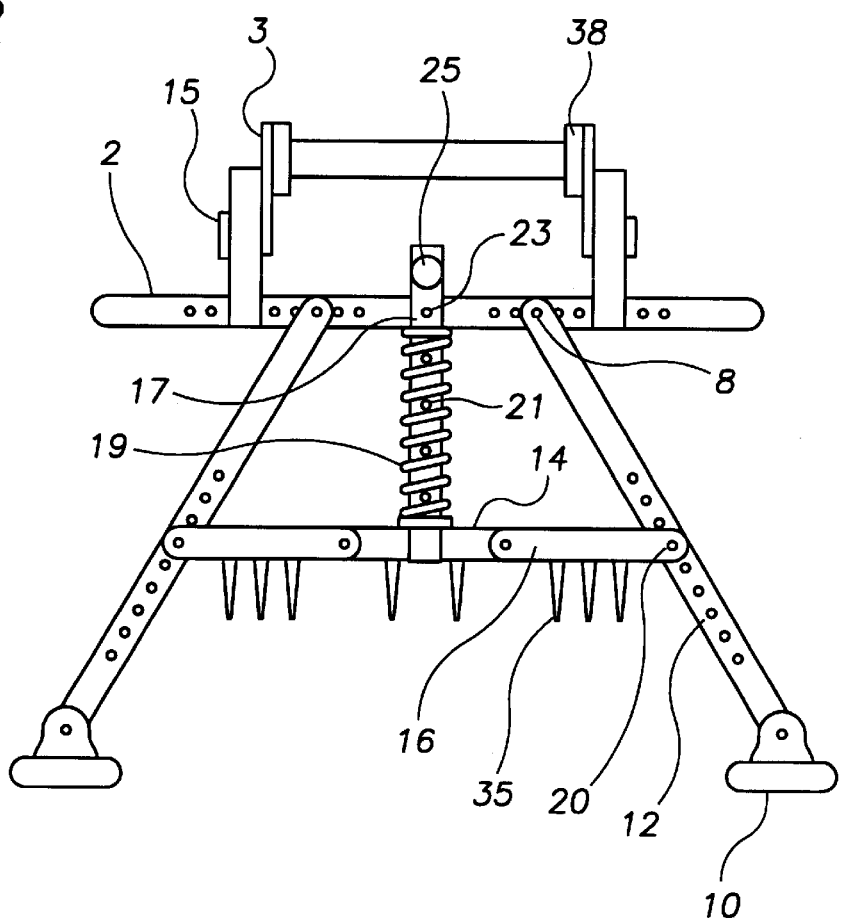
FIG. 2 is a top view of the device.
Figure 4:
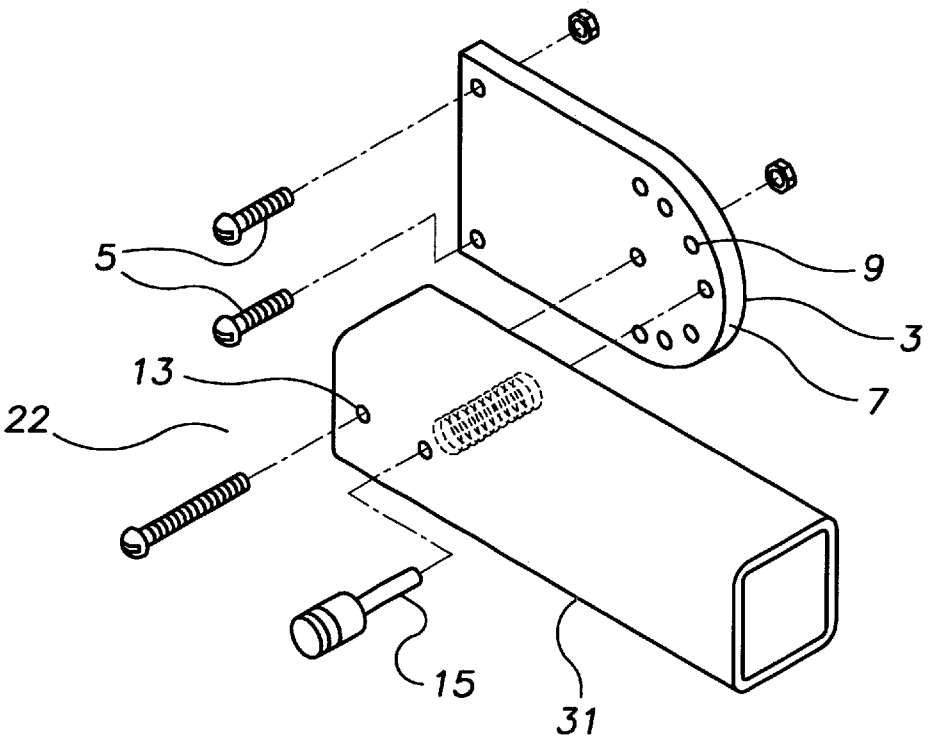
FIG. 4 is a detailed view of a bracket assembly.
Figure 3:
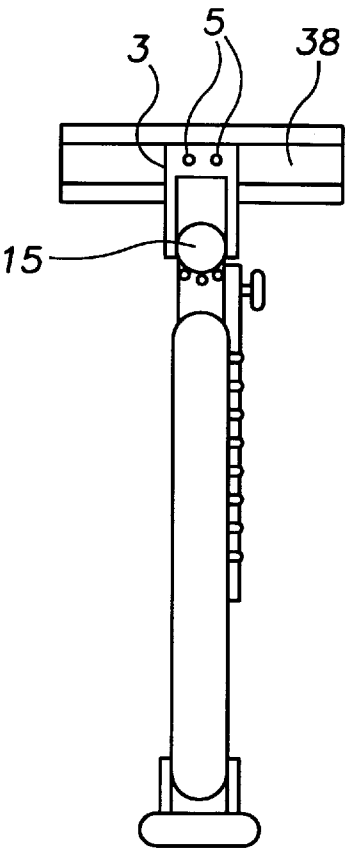
FIG. 3 is a side view of the device.

Referring now to FIGS. 1–3, the present invention relates to a ladder attachment for stabilizing and supporting the top end of a ladder at a predetermined distance from a vertical surface such as a wall, pole, tree or similar object. The device comprises an elongated central portion 2 having a plurality of apertures 4 longitudinally disposed thereon. Pivotally attached to the central portion are a pair of diverging spaced arms 30. A first end of each arm includes an aperture that may be aligned with any of the apertures on the central portion to receive a locking pin 8. Accordingly, each arm may be selectively positioned relative to the central portion to vary the spacing therebetween. Pivotally attached to a second, distal end of each arm is a pad 10 for stabilizing the arms and for minimizing damage to the vertical support structure when placed thereagainst. Each arm also includes a plurality of apertures 12 extending along an intermediate portion thereof.

Interconnecting the arms is an elongated cross member 14 formed of a plurality of independently pivotable sections 16. The cross member includes two ends each having an aperture thereon that is aligned with a select one of the intermediate apertures on a side arm. A pin 20 is inserted through the aligned apertures allowing the position of the cross member to be selectively varied relative to either of the side arms.

The central portion is mounted to the side rails 38 of the extension ladder with a pair of bracket assemblies 22. Each bracket assembly includes a plate 3 that is fastened to a designated side rail with screws 5 or similar means. Each plate also includes a contoured semi-circular edge 7 having a plurality of radially disposed apertures 9 adjacent thereto. A pair of elongated braces 31 are attachable at their respective first ends to a select location on the central portion with pins or similar means. The opposing end of each brace includes a first aperture 13 for receiving a screw or similar fastener to secure each brace to one of the plates. Each brace also includes a spring biased locking knob 15 that is removably insertable into any one of the radially disposed apertures on the plate allowing the angular position of the device to be easily varied relative to the ladder.

Interconnecting an intermediate portion of the cross member and the central portion is a shaft 17. The shaft is encompassed with a spring 19 that abuts the central portion and the cross member to bias the two components in opposite directions. The shaft includes a plurality of apertures 21 disposed along substantially the entire length thereof each for receiving a locking pin 23 when aligned with an aperture on the central portion. The shaft also includes a knob 25 which is grasped by a user to selectively position the shaft relative to the central portion causing the cross member to extend or collapse thereby adjusting the spacing of the arms. When the shaft has been placed at the desired position, it can be secured to the central portion with the locking pin thereby locking the arms at the selected spacing.

Removably mounted to the cross member are a plurality of spikes 35 for engaging a tree trunk or similar penetratable surface to further secure the ladder. Each spike includes a threaded bore for receiving a screw or similar device to secure the spikes to the cross member.

To use the above described device, the plates are mounted to the ladder side rails and the central portion is secured thereto at a desired angle. The top end of the ladder is then leaned toward a vertical structure such as a wall, tree or pole and the support arms will support the top end of the ladder at a predetermined distance therefrom. The spacing of the arms may be varied, if desired, to provide more or less space therebetween or to encompass a vertical structure having a specific diameter. The spacing can be varied by repositioning the arms or the shaft relative to the central portion.

The above described device is preferably constructed with steel, aluminum or a similar equivalent. However, as will be readily apparent to those skilled in the art, the size, shape and materials of construction of the various components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A ladder attachment for supporting the top end of a ladder a predetermined distance from a vertical surface, said attachment comprising:

an elongated central portion attachable to side rails of a ladder;

a pair of spaced side arms, each having first and second ends, the first end of each arm pivotally attached to said central portion, the second end of each arm extending outwardly from the ladder for abutting the vertical surface to support said ladder in a substantially upright position while suspending said ladder a predetermined distance from said vertical surface; said arms interconnected with a cross member, said cross member formed of a plurality of independently pivotal sections whereby said cross member can be extended and collapsed to vary the spacing between said side arms;

a translatable spring biased shaft interconnecting said cross member and said central portion to vary the spacing between said arms.

2. A ladder attachment according to claim 1 wherein said cross member includes a plurality of spikes extending therefrom for engaging a support surface to prevent a ladder from shifting.

3. A ladder attachment according to claim 1 wherein the second end of each side arm includes a foot pad pivotally attached thereto for stabilizing the ladder and for minimizing impact with the vertical surface.

4. A ladder attachment according to claim 1 wherein the first end of each arm is attachable at a select location along said central portion to vary the spacing between said arms.

5. A ladder attachment according to claim 1 wherein said shaft is securable to said central portion at a desired position relative thereto.

6. A ladder attachment according to claim 1 wherein said central portion is mountable to ladder side rails with a bracket assembly thereby allowing the angular position of the central portion to be selectively varied relative to said ladder.

7. A ladder attachment according to claim 6 wherein said bracket assembly comprises:

a plate securable to a ladder side rail, said plate having a plurality of radially disposed apertures thereon;

a pair of braces secured to the central portion, each brace rotatably attached to one of said plates;

a spring biased locking knob mounted within each brace and extending therefrom, each knob selectively insertable into any of said radially disposed apertures to vary the angular orientation of said central portion.

* * * * *